US007201108B2

(12) United States Patent
Eusebi et al.

(10) Patent No.: US 7,201,108 B2
(45) Date of Patent: Apr. 10, 2007

(54) TABLE WITH VARIABLE CONFIGURATION

(75) Inventors: Publio Eusebi, Rome (IT); Alfio Padovan, Azzano Decimo (IT)

(73) Assignee: F & F srl, Azzáno Decimo (PN) (IT)

( * ) Notice: Subject to any disclaimer, the term of this patent is extended or adjusted under 35 U.S.C. 154(b) by 339 days.

(21) Appl. No.: 10/788,457

(22) Filed: Mar. 1, 2004

(65) Prior Publication Data

US 2004/0187742 A1 Sep. 30, 2004

(30) Foreign Application Priority Data

Mar. 3, 2003 (IT) ..... UD2003A0049

(51) Int. Cl.
*A47B 1/04* (2006.01)

(52) U.S. Cl. ..... 108/76; 108/99; 108/71

(58) Field of Classification Search ..... 248/281.11, 248/276.1, 284.1, 291.1, 292.13, 184.1; 108/76, 108/99, 71, 84, 100, 96, 138, 136, 77, 17, 108/161, 66, 115, 26, 167, 171, 145, 146, 108/147

See application file for complete search history.

(56) References Cited

U.S. PATENT DOCUMENTS 2,008,613 A * 7/1935 Hernes ..... 108/90
4,194,452 A * 3/1980 Crowther et al. ..... 108/138
5,549,052 A * 8/1996 Hoffman ..... 108/139
6,003,450 A 12/1999 Bruckner et al.
6,991,199 B2 * 1/2006 Carpentier ..... 248/122.1

FOREIGN PATENT DOCUMENTS

GB 285557 2/1928

* cited by examiner

*Primary Examiner*—Janet M. Wilkens
(74) *Attorney, Agent, or Firm*—Stevens, Davis, Miller & Mosher, LLP

(57) ABSTRACT

Table (10) with variable configuration comprising at least a frame (11) and a movement assembly (12), associated with said frame (11), for a main plane (13) and a service plane (14); such movement assembly (12) comprises two mechanisms (18, 19): a first mechanism (18) that acts on the main plane (13) to take it from a lowered position to a raised position, and a second mechanism (19) that acts on the service plane (14) to take it below the main plane (13) in such lowered position and adjacent to the main plane (13) in such raised position.

17 Claims, 4 Drawing Sheets

TABLE WITH VARIABLE CONFIGURATION

FIELD OF THE INVENTION

The present invention concerns a table with variable configuration, able to be used both as a sitting-room table and also as a dining table or work-table.

BACKGROUND OF THE INVENTION

Various types of tables with variable configuration are known, in which it is possible to vary the amplitude and/or height from the floor of the supporting plane so as to allow its use for different purposes.

Some of these tables include a plane folding like a book, associated with movement means in the form of crossed arms or a pantograph, which allow to take the plane from a lowered position to a raised position, and vice versa.

The plane can be made to slide laterally with respect to the movement means, or to the frame on which the latter are mounted, and then opened in order to substantially double its amplitude.

Other tables provide lifting means with a crank, a piston or suchlike.

However, in known solutions the possible configurations of the table are substantially limited to a first condition, wherein the plane is lowered and folded, and a second condition wherein the plane is raised and possibly open.

Moreover, as it passes from the lowered position to the raised position, the plane is kept in axis with respect to the lifting means, or the frame, so that in order to extend it there is the necessary firstly to translate it laterally, making it slide on appropriate guides, and then open it.

From U.S. Pat. No. 6,003,450 it is also known a lift apparatus which includes a folding frame assembly and a pair of support members which are connected to the folding frame assembly by a linkage. The lift apparatus is mounted on a table base and is capable of an open position in which a single foldable table top is lifted to a height appropriate for a dining table. In the open position the support members are able to support a hinged leaf of the foldable table top which, by folding, increases the size of the table top. However, this known lift apparatus has the disadvantage that the support members and the kind of linkage associated thereto do not guarantee a stable position of the hinged leaf in the open position, so rendering very unstable the entire table top.

The present invention has set itself the purpose of making a table with variable configuration which is simple to construct and versatile and reliable in use.

Another purpose of the invention is to make a table with variable configuration wherein the relative plane can be raised and lowered easily and extended without the need for the user to make it slide laterally.

The Applicants have devised, tested and embodied the present invention in order to overcome the shortcomings of the state of the art, to achieve the purposes mentioned above and to obtain other advantages.

BACKGROUND OF THE INVENTION

The present invention is set forth and characterized essentially in the main claim, while the dependent claims describe other innovative characteristics of the invention.

The table according to the present invention comprises a supporting frame, able to rest on the floor, a main plane, a service plane and a movement assembly associated with the frame and able to move both the main plane and the service plane from a lowered position to a raised position and vice versa.

To be more exact, the movement assembly comprises two mechanisms: a first mechanism able to cause the lifting and lowering of the main plane, and a second mechanism able to move the service plane below the main plane in the lowered position and to its side in the raised position.

In their raised position, the main plane and the service plane are arranged off-center with respect to the frame.

According to one aspect of the invention, such two mechanisms are connected to each other by means of at least a rod able to cause the second mechanism to be driven simultaneously to the drive of the first mechanism, so that the lifting and lowering of the main plane causes a corresponding lifting and lowering of the service plane.

In a preferential form of embodiment, each mechanism comprises at least a pair of oscillating arms, parallel to each other, pivoted at a first point to the frame and at a second point to relative connection means with the respective planes.

According to a variant, each mechanism comprises two pairs of oscillating arms; in this embodiment the arms of the second mechanism are arranged in the space defined between the arms of the first mechanism.

According to another variant, at least the first mechanism is connected to the frame by means of elastic thrust and return means, which encourage the lifting and lowering of the main plane and the service plane, considerably reducing the efforts required by the user.

In a preferential form of embodiment, the main plane is divided into two substantially equal parts, first and second, hinged to and superimposed one above the other.

To be more exact, in its lowered position the main plane has the first part folded over the second part; in the raised position, on the contrary, the main plane can be used either keeping the two parts superimposed one above the other, or by overturning the first part to rest on the service plane, so that it is arranged adjacent and co-planar to the second part.

The extension of the main plane, which substantially allows to double its usable supporting surface, is then achieved simply by overturning the first part, without needing to translate the main plane laterally, since the latter is already off-center with respect to the frame.

The table according to the invention can therefore be used in three different configurations: a first configuration with main plane lowered and service plane retracted below it; a second configuration with main plane and service plane raised and adjacent to each other; and a third configuration with main plane raised and extended.

BRIEF DESCRIPTION OF THE DRAWINGS

These and other characteristics of the present invention will be apparent from the following description of a preferential form of embodiment, given as a non-restrictive example, with reference to the attached drawings wherein.

DESCRIPTION OF A PREFERENTIAL FORM OF EMBODIMENT OF THE INVENTION

Figure 1:
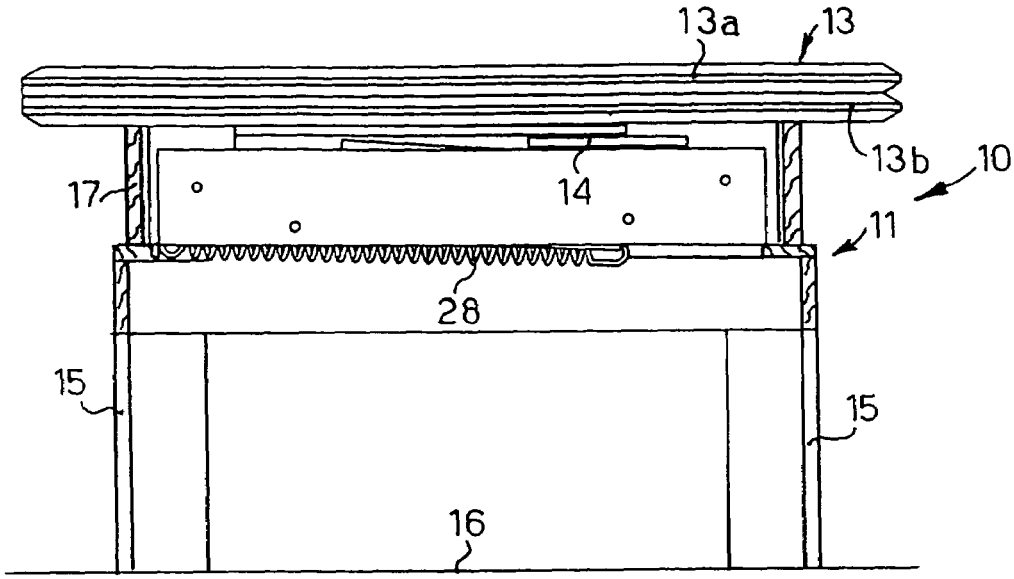
FIG. 1 is a front view, partly in section, of a table according to the invention in a first configuration of use.

With reference to the attached drawings, the number 10 denotes in its entirety the table with variable configuration according to the present invention.

The table 10 comprises a frame 11 on which a movement assembly 12 is mounted, able to move a main plane (i.e. main table-top) 13 and a service plane (i.e. service table-top) 14 from a lowered position to a raised position and vice versa.

In this case, the frame 11 has four legs 15 resting on the floor 16, which support a box-like structure 17 open at the top.

Inside the box-like structure 17 there is a container 29 for objects.

The main plane 13 is of the extendable type and is made of two parts, first 13*a* and second 13*b*, hinged together and superimposed.

To be more exact, when the main plane 13 is extended normally (FIG. 1), the first part 13*a* is above the second part 13*b* while, in the extended condition of the main plane 13 (FIG. 4) the first part 13*a* is arranged adjacent and co-planar to the second part 13*b*.

The service plane 14 is of smaller size than one part 13*a*, 13*b* of the main plane 13 and is able to be arranged retracted below the latter in its lowered position.

The movement assembly 12 comprises two mechanisms with oscillating arms, first 18 and second 19, able respectively to allow the movement of the main plane 13 and the service plane 14.

The first mechanism 18 comprises two pairs of arms each consisting of an inner arm 20 and an outer arm 21, parallel to each other.

Similarly, the second mechanism 19 comprises two pairs of arms each consisting of an inner arm 22 and an outer arm 23, parallel to each other.

The arms 22 and 23 of the second mechanism 19 are arranged in the space between the arms 20 and 21 of the first mechanism 18.

The outer arms 21 of the first mechanism 18 are pivoted at the lower end 21*a* to the box-like structure 17, and at the upper end 21*b* to a relative bracket 24, which is solid with a plate 25 fixed below the second part 13*b* of the main plane 13.

The inner arms 20 of the first mechanism 18 are pivoted at the lower end 20*a* to one end of respective connection rods 27, whose other end is pivoted at an intermediate point 22*c* of the inner arms 22 of the second mechanism 19. The inner arms 20 also have the upper end 20*b* pivoted to the relative bracket 24 and are pivoted at an intermediate point 20*c* to the sides of the box-like structure 17.

A spring 28 connects the lower end 20*a* of each inner arm 20 to a peripheral point of the box-like structure 17.

The arms 22 and 23 of the second mechanism 19 are pivoted respectively with the lower ends 22*a* and 23*a* to the box-like structure 17 and with the upper ends 22*b* and 23*b* to a relative bracket 26 fixed below the service plane 14.

In a first configuration, shown in FIG. 1, the table 10 has the main plane 13 folded back and in the lowered position resting on the box-like structure 17, so as to be used as a sitting room table.

In this condition, the arms 20, 21, 22, 23 of the mechanisms 18 and 19 are folded back one towards the other inside the box-like structure 17, where the service plane 14 is also housed in a retracted position.

The table 10 can also assume a second configuration that allows to use both the main plane 13 and also the service plane 14.

To take the table 10 from the first to the second configuration it is sufficient to grip the main plane 13 and lift it; in this way the arms 20 and 21 of the first mechanism 18 move progressively from the initial folded position to a substantially erect position slightly inclined outwards.

Figure 2:
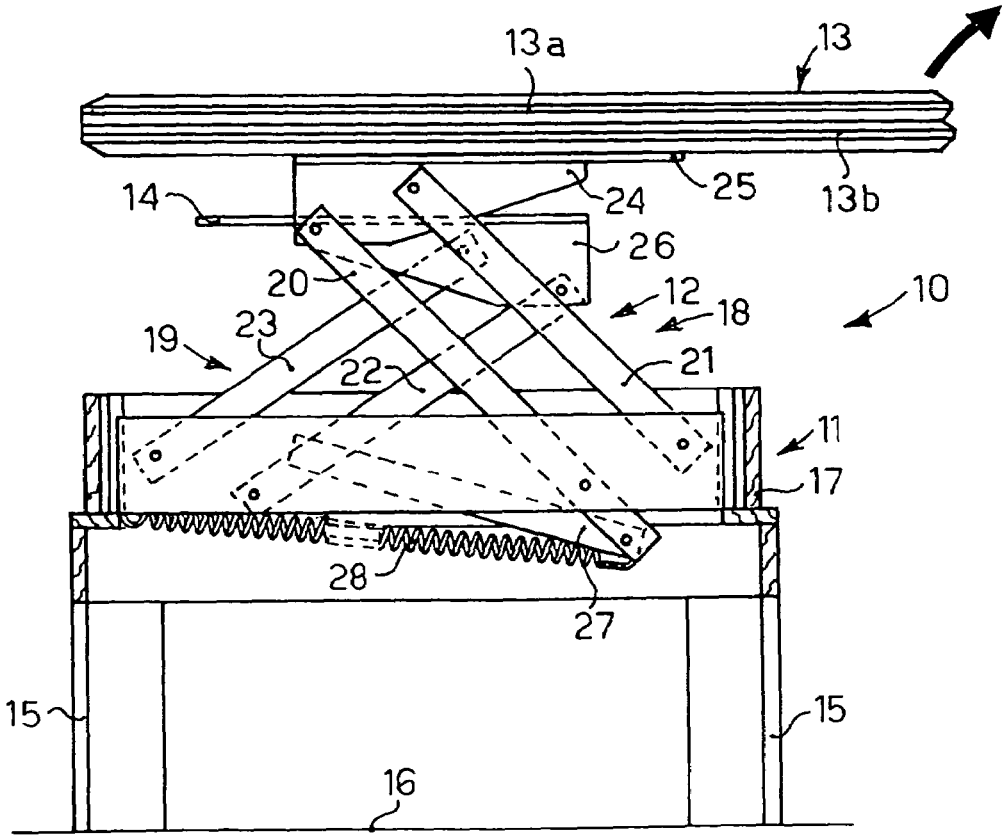
FIG. 2 shows the table in FIG. 1 in the process of being lifted.

The movement of the inner arm 20 of the first mechanism 18 causes the rod 27 to thrust the inner arm 22 of the second mechanism 19, which also moves to an erect position drawing the mating outer arm 23 and thus causing the service plane 14 to be lifted (FIG. 2).

In this step, after an initial resistance that allows the main plane 13 to keep stably resting on the box-like structure 17, in its lowered position, the spring 28 gives the inner arm 20 a thrust which encourages the lifting of the main plane 13, so as to considerably reduce the effort which the user has to exert.

Figure 3:
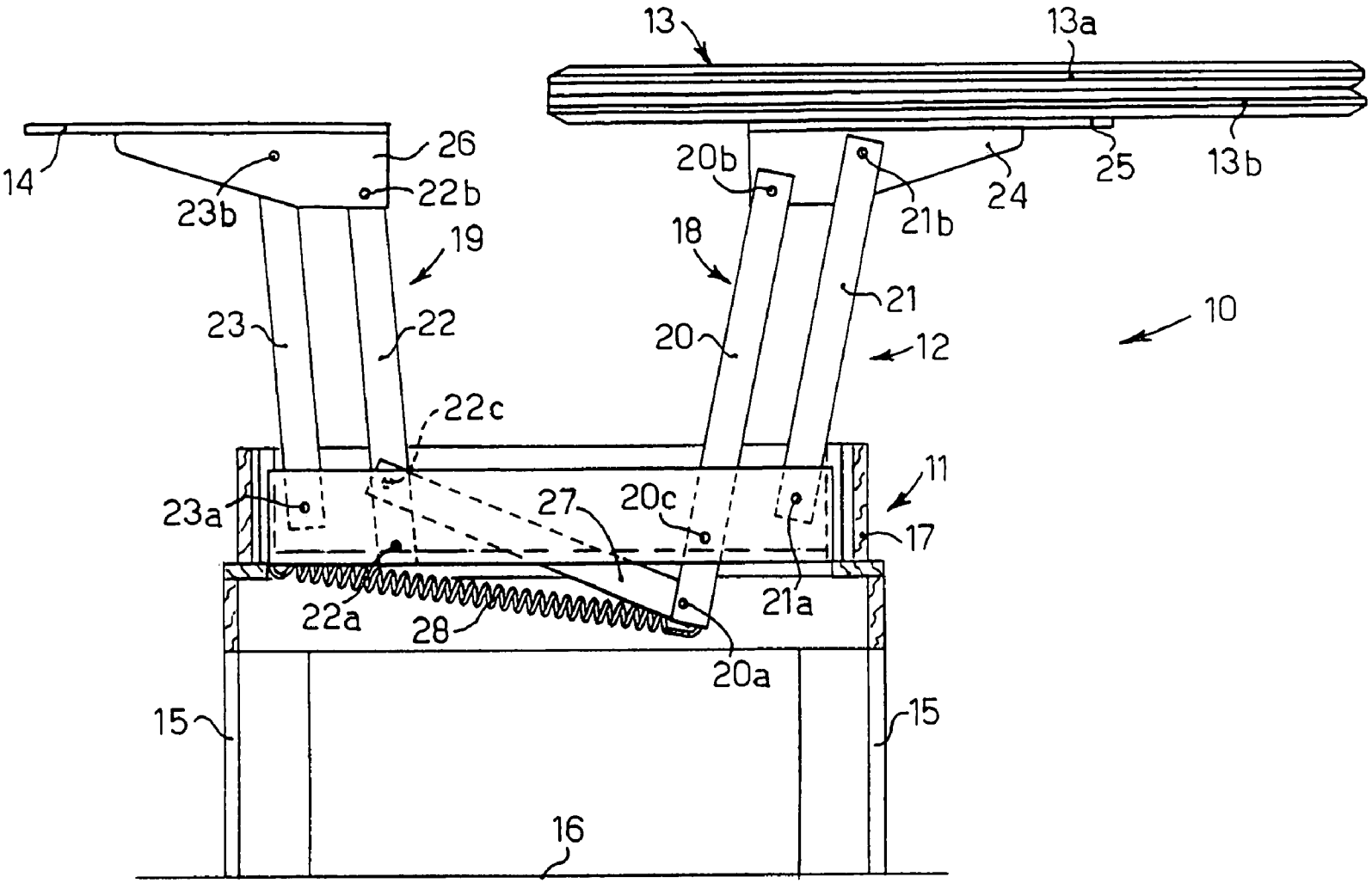
FIG. 3 shows the table in FIG. 1 in a second configuration of use.

Once the completely raised position has been reached (FIG. 3), the main plane 13 and the service plane 14 are arranged one adjacent to the other, with the upper surface of the service plane 14 substantially co-planar to the lower surface of the second part 13*b* of the main plane 13.

In this condition the service plane 14 can be used as a supplementary resting plane for objects such as bottles, plates or other, which otherwise would occupy space on the main plane 13.

In such second configuration, the structure of the mechanisms 18 and 19 guarantees an effective transmission to the frame 11 of the loads weighing on the planes 13, 14, so that it is possible to use even only one of the planes 13, 14 without compromising the stability of the table 10.

Figure 4:
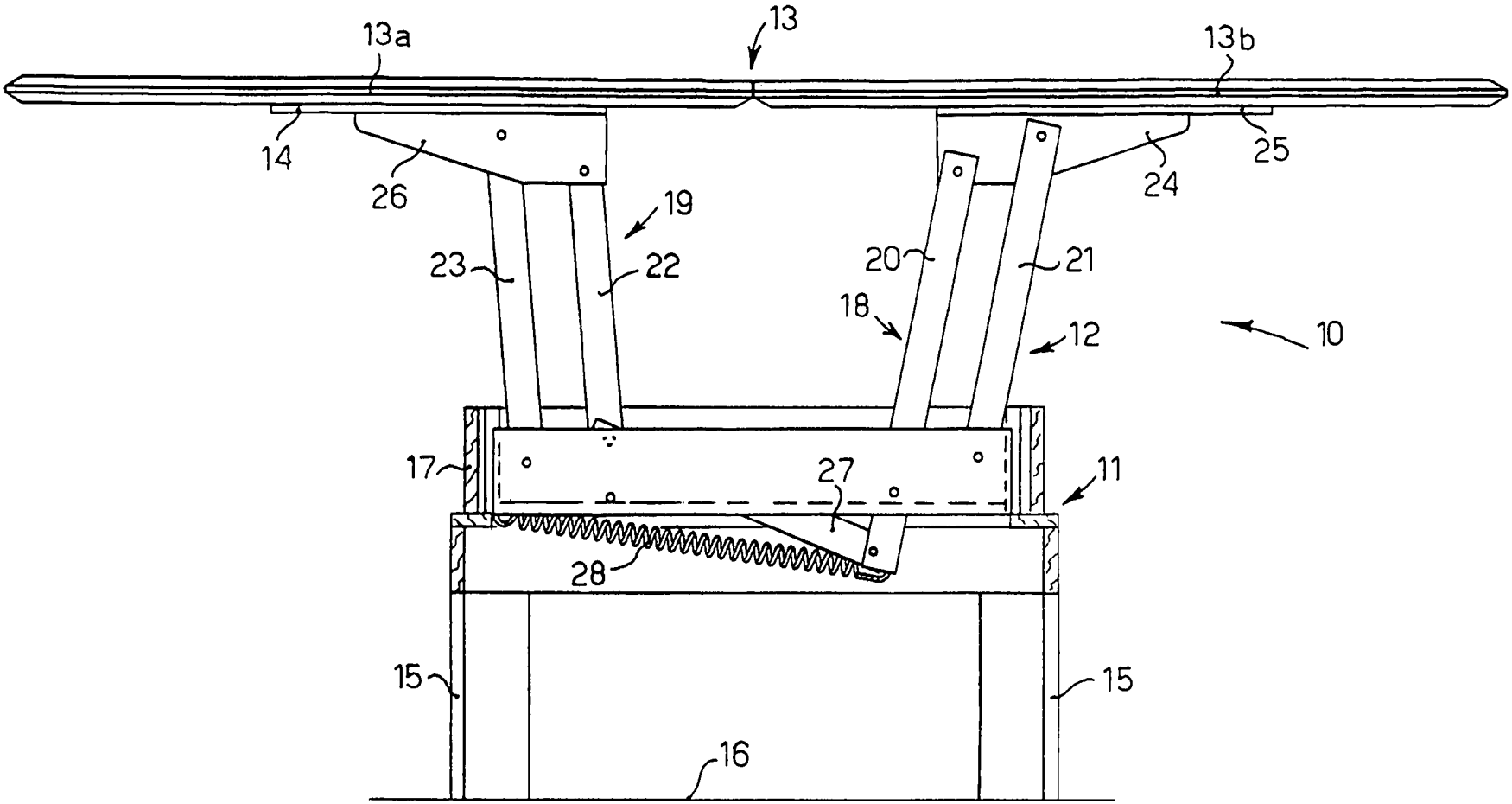
FIG. 4 shows the table in FIG. 1 in a third configuration of use.
Figure 5:
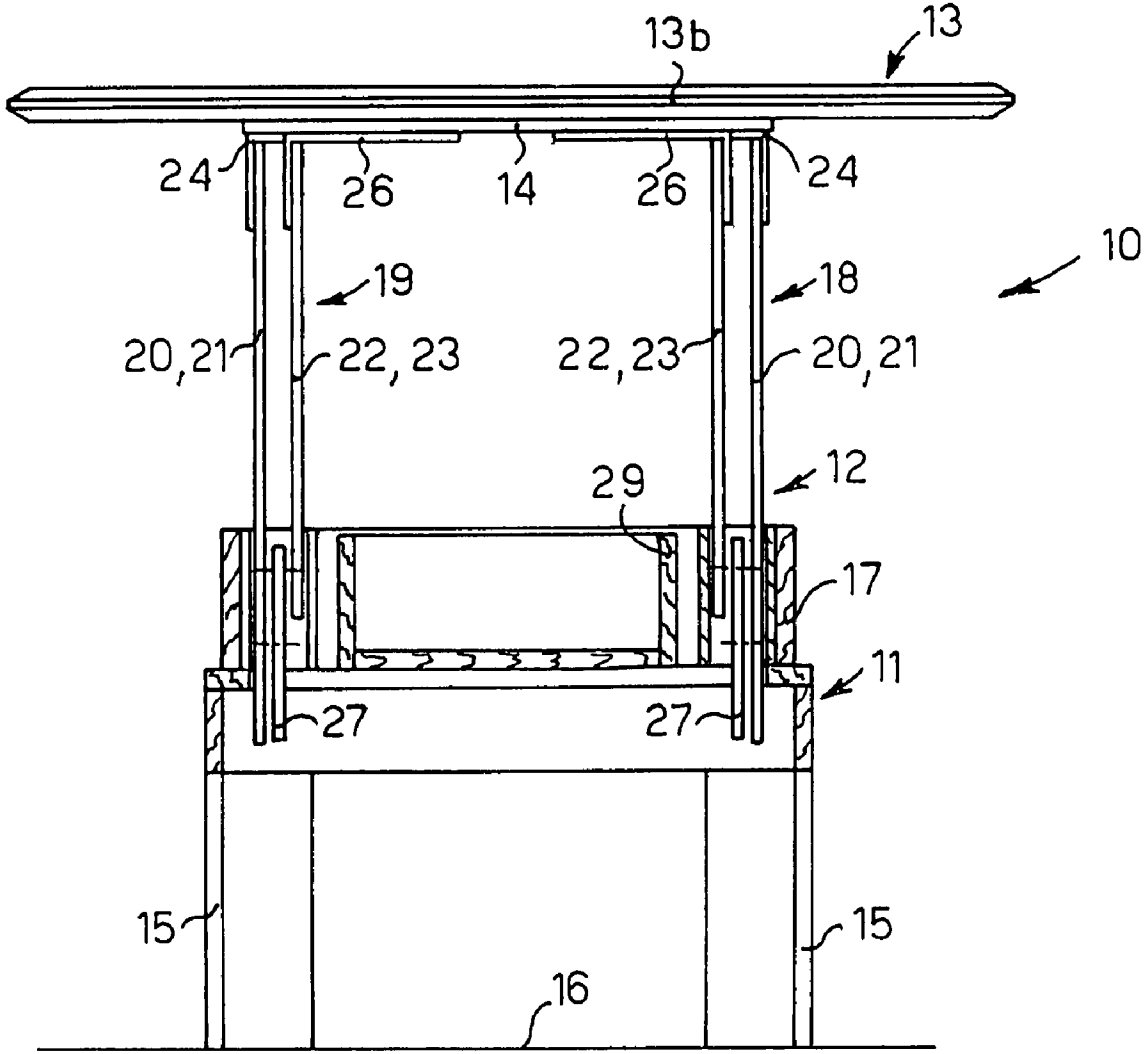
FIG. 5 is a partly sectioned lateral view of the table in FIG. 4.

Should it be necessary to arrange a bigger supporting plane, the table 10 can assume a third configuration, simply by overturning the first part 13*a* of the main plane 13 so as to make it rest on the service plane 14 in a position adjacent and co-planar to the second part 13*b* (FIG. 4).

It is clear that modifications and/or additions of parts can be made to the table 10 as described heretofore, without departing from the field and scope of the present invention.

For example, the frame 11 could be made differently from the way shown here.

Or the mechanisms 18 and 19 could consist of a single pair of parallel arms arranged in a centered position with respect to the frame 11.

It is also clear that, although the present invention has been described with reference to specific examples, a person of skill in the art shall certainly be able to achieve many other equivalent forms of a table with variable configuration, all of which shall come within the field and scope of the present invention.

The invention claimed is:

1. Table with variable configuration comprising at least:

a frame supporting a main table-top, and an assembly, associated with said frame and able to move said main table-top from a lowered position to a raised position and vice versa, wherein:

said assembly comprises a first mechanism and a second mechanism, said first mechanism is connected to said main table-top to selectively lift or lower said main table-top, said second mechanism is connected to a service table-top, substantially parallel to said main table-top to normally take said service table-top below said main table-top in said lowered position and substantially adjacent to said main table-top in said raised position, said first and second mechanisms are connected to each other by means of at least a connection element able to effect the drive of said second mechanism simultaneously to the drive of said first mechanism, so that the lifting and lowering of said service table-top occurs in coordination with the lifting and lowering of said main table-top, and at least said first mechanism is connected to said frame by means of elastic thrust and return means able to encourage the lifting and lowering of said main table-top.

2. Table as in claim 1, wherein each of said first and second mechanisms comprises at least a pair of oscillating arms parallel to each other, each of said arms being pivoted at a first point to said frame and at a second point to relative means of connection with said main table-top and service table top.

3. Table as in claim 2, wherein each of said mechanisms comprises two pairs of said arms, the arms of said second mechanism being arranged in the space defined between the arms of said first mechanism.

4. Table as in claim 1, wherein in said raised position, said main table-top and said service table-top are arranged off-center with respect to said frame.

5. Table as in claim 1, wherein said main table-top is divided into two parts, first and second, said first part being hinged to and superimposed above said second part.

6. Table as in claim 5, wherein in said raised position, said first part is able to be rested on said service table-top in order to be arranged adjacent and co-planar to said second part.

7. Table as in claim 1, wherein said frame comprises a box-like structure inside which said mechanisms and said service table-top are able to be accommodated in said lowered position.

8. Table as in claim 7, wherein inside said box-like structure a compartment is made to contain objects.

9. Table with variable configuration comprising at least:

a frame supporting a main table-top, and an assembly, associated with said frame and able to move said main table-top from a lowered position to a raised position and vice versa, wherein:

said assembly comprises a first mechanism and a second mechanism, said first mechanism is connected to said main table-top to selectively lift or lower said main table-top, said second mechanism is connected to a service table-top, substantially parallel to said main table-top to normally take said service table-top below said main table-top in said lowered position and substantially adjacent to said main table-top in said raised position, said first and second mechanisms are connected to each other by means of at least a connection element able to effect the drive of said second mechanism simultaneously to the drive of said first mechanism, so that the lifting and lowering of said service table-top occurs in coordination with the lifting and lowering of said main table-top, wherein said a frame comprises box-like structure inside which said mechanisms and said service table-top are able to be accommodated in said lowered position and inside said box-like structure a compartment is made to contain objects.

10. Table as in claim 9, wherein at least said first mechanism is connected to said frame by means of elastic thrust and return means able to encourage the lifting and lowering of said main table-top.

11. Table as in claim 10, wherein said elastic thrust and return means comprise at least a spring constrained to one end of an arm of said first mechanism.

12. Table as in claim 10, wherein said elastic means comprise at least a spring constrained to one end of an arm of said first mechanism.

13. Table with variable configuration comprising at least:

a frame supporting a main table-top, and an assembly, associated with said frame and able to move said main table-top from a lowered position to a raised position and vice versa, wherein:

said assembly comprises a first mechanism and a second mechanism, said first mechanism is connected to said main table-top to selectively lift or lower said main table-top, said second mechanism is connected to a service table-top, substantially parallel to said main table-top to normally take said service table-top below said main table-top in said lowered position and substantially adjacent to said main table-top in said raised position, each of said first and second mechanisms comprises at least a pair of oscillating arms parallel to each other, each of said arms being pivoted at a first point to said frame and at a second point to relative means of connection with said main table-top and service table top, each of said mechanisms comprises two pairs of said arms, the arms of said second mechanism being arranged in the space defined between the arms of said first mechanism, and at least said first mechanism is connected to said frame by means of elastic thrust and return means able to encourage the lifting and lowering of said main table-top.

14. Table as in claim 13, wherein said first and second mechanisms are connected to each other by means of at least a connection element able to effect the drive of said second mechanism simultaneously to the drive of said first mechanism, so that the lifting and lowering of said service table-top occurs in coordination with the lifting and lowering of said main table-top.

15. Table as in claim 14, wherein said connection element comprises a stiff rod, associated both to one end of an arm of said first mechanism and also to an intermediate point of an arm of said second mechanism.

16. Table as in claim 14, wherein each of said first and second mechanisms comprises at least a pair of oscillating arms parallel to each other, each of said arms being pivoted at a first point to said frame and at a second point to relative means of connection with said main table-top and service table top.

17. Table with variable configuration comprising at least:

a frame supporting a main table-top, and an assembly, associated with said frame and able to move said main table-top from a lowered position to a raised position and vice versa, wherein:

said assembly comprises a first mechanism and a second mechanism, said first mechanism is connected to said main table-top to selectively lift or lower said main table-top, said second mechanism is connected to a service table-top, substantially parallel to said main table-top to normally take said service table-top below said main table-top in said lowered position and substantially adjacent to said main table-top in said raised position, each of said first and second mechanisms comprises at least a pair of oscillating arms parallel to each other, each of said arms being pivoted at a first point to said frame and at a second point to relative means of connection with said main table-top and service table top, each of said mechanisms comprises two pairs of said arms, the arms of said second mechanism being arranged in the space defined between the arms of said first mechanism, wherein said frame comprises a box-like structure inside which said mechanisms and said service table-top are to be accommodated in said lowered position and inside said box-like structure a compartment is made to contain objects.

* * * * *